US008247749B2

(12) United States Patent
Doyon et al.

(10) Patent No.: US 8,247,749 B2
(45) Date of Patent: Aug. 21, 2012

(54) APPLICATION OF ELECTRIC INDUCTION ENERGY FOR MANUFACTURE OF IRREGULARLY SHAPED SHAFTS WITH CYLINDRICAL COMPONENTS INCLUDING NON-UNITARILY FORGED CRANKSHAFTS AND CAMSHAFTS

(75) Inventors: Gary A. Doyon, Grosse Pointe Farms, MI (US); Douglas R. Brown, Rochester Hills, MI (US); Don L. Loveless, Rochester, MI (US); Valery I. Rudnev, Rochester Hills, MI (US)

(73) Assignee: Inductoheat, Inc., Madison Heights, MI (US)

( * ) Notice: Subject to any disclaimer, the term of this patent is extended or adjusted under 35 U.S.C. 154(b) by 299 days.

(21) Appl. No.: 12/830,313

(22) Filed: Jul. 3, 2010

(65) Prior Publication Data

US 2011/0000905 A1 Jan. 6, 2011

Related U.S. Application Data

(60) Provisional application No. 61/223,022, filed on Jul. 4, 2009.

(51) Int. Cl.
*H05B 6/10* (2006.01)

(52) U.S. Cl. ..... 219/639; 219/660; 219/674

(58) Field of Classification Search ..... 219/535, 219/637, 639, 660, 672, 674, 675, 676; 29/888.08, 29/888.1
See application file for complete search history.

(56) References Cited

U.S. PATENT DOCUMENTS

| | | | | |
|---|---|---|---|---|
| 2,472,261 | A | 8/1944 | Mueller | |
| 3,924,439 | A | 12/1975 | Poncin | |
| 4,399,681 | A | 8/1983 | Hatsuno | |
| 6,628,404 | B1 | 9/2003 | Kelley et al. | |
| 2010/0319642 | A1 * | 12/2010 | Fujita et al. | 123/90.44 |

FOREIGN PATENT DOCUMENTS

| | | | |
|---|---|---|---|
| JP | 2004-162137 | A | 6/2004 |
| JP | 2008-043999 | A | 2/2008 |
| JP | 2008-088473 | A | 4/2008 |
| KR | 10-2008-0027508 | A | 3/2008 |

* cited by examiner

*Primary Examiner* — Hoai V Pham
(74) *Attorney, Agent, or Firm* — Philip O. Post

(57) ABSTRACT

Large, non-unitarily forged shaft workpieces such as a crankshaft have successive shaft features inductively heated and forged without cool down between each sectional forging process. The temperature profile along the axial length of the next section of the shaft workpiece to be inductively heated and forged is measured prior to heating, and the induced heat energy along the axial length of the next section is dynamically adjusted responsive to the measured temperature profile to achieve a required pre-forge temperature distribution along the axial length of the next section prior to forging.

20 Claims, 7 Drawing Sheets

PRIOR ART

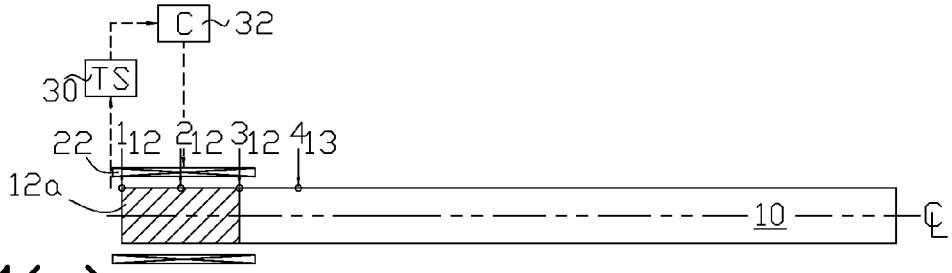
FIG. 4(a)
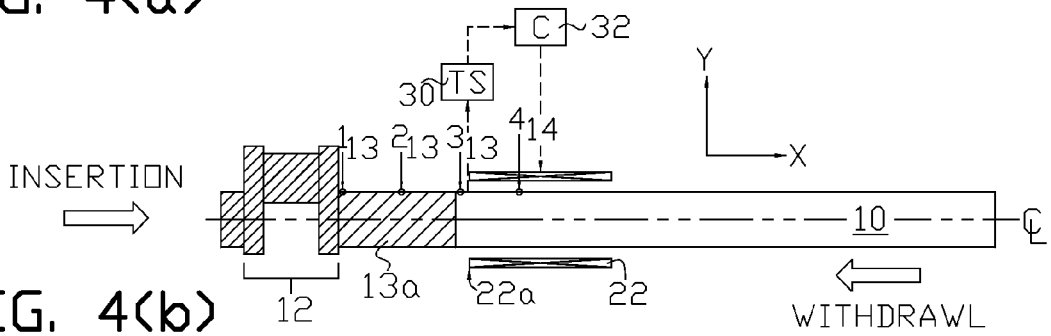
FIG. 4(b)
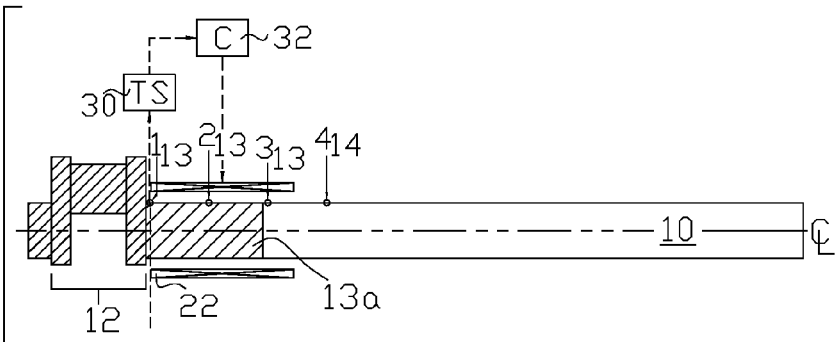
FIG. 4(c)
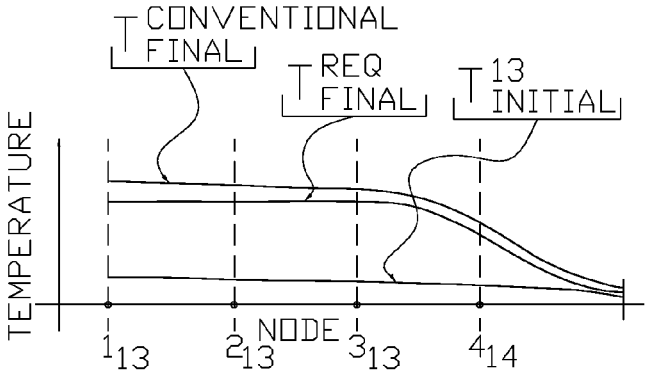

APPLICATION OF ELECTRIC INDUCTION ENERGY FOR MANUFACTURE OF IRREGULARLY SHAPED SHAFTS WITH CYLINDRICAL COMPONENTS INCLUDING NON-UNITARILY FORGED CRANKSHAFTS AND CAMSHAFTS

CROSS REFERENCE TO RELATED APPLICATIONS

This application claims the benefit of U.S. Provisional Application No. 61/223,022, filed Jul. 4, 2009, hereby incorporated by reference in its entirety.

FIELD OF THE INVENTION

The present invention relates to electric induction heat treatment of irregularly shaped shafts, and in particular to a class of irregularly shaped shafts known in the art as large, or non-unitarily forged shafts, such as large crankshafts and camshafts suitable for use in large horsepower internal combustion engines utilized for motive power in marine or rail applications, or for electric generator prime movers.

BACKGROUND OF THE INVENTION

Large crankshafts, such as those utilized in marine main propulsion engines can exceed 20 meters in overall axial length and weigh in excess of 300 tonnes. A large crankshaft comprises a series of crankpins (pins) and main journals (mains) interconnected by crank webs (webs) and counterweights. The diameter of the journals can be as long as 75 mm (3 inches) and can exceed 305 mm (12 inches). Large crankshafts are heated and hot formed, for example by a hot rolling or forging process, which is favored over rolling. Steel forgings, nodular iron castings and micro-alloy forgings are among the materials most frequently used for large crankshafts. Exceptionally high strength, sufficient elasticity, good wear resistance, geometrical accuracy, low vibration characteristics, and low cost are important factors in the production of large crankshafts.

One known process for manufacturing large, or non-unitarily forged, crankshafts is diagrammatically illustrated, in part, in FIG. 1(*a*) through FIG. 1(*g*). The term "non-unitarily forged" is used since the massive size of large crankshafts, and other irregularly shaped large axial shaft components do not permit forging of the entire crankshaft at one time, as is done, for example, with smaller crankshafts used in the internal combustion engines of automobiles. The feedstock, workpiece or blank 10 used in the process is typically a drawn cylindrically shaped blank as shown in cross section in FIG. 1(*a*) at ambient temperature. Blank 10 may be, for example, a steel composition having an overall longitudinal (axial) length, L, of 20 meters and weight of 200 tonnes. Initially as shown in FIG. 1(*b*) a first pre-forge section 12*a* (shown crosshatched) of blank 10 is positioned within multiple turn induction coil 20 as diagrammatically illustrated in cross section. Alternating (AC) current is supplied to the induction coil from a suitable source (not shown in the drawings) to generate a magnetic field that couples with pre-forge section 12*a* to inductively heat pre-forge section 12*a* to a desired pre-forge temperature. Upon achieving the desired temperature in pre-forge section 12*a*, blank 10 is transported to a forging press (not shown in the figures) to forge an appropriate crankshaft feature or component, such as a first main journal or crankpin journal (referred to as the "first journal 12"). Forging temperatures typically used for steel compositions can range between 1093° C. to 1316° C. (2000° F. to 2400° F.). Subsequent to forging first journal 12, entire blank 10 is cooled down to near ambient temperature. Second pre-forge section 13*a* (shown crosshatched) of the blank is then positioned within the induction coil to heat pre-forge section 13*a* to forge temperature as shown in FIG. 1(*c*). Similar to the process for first pre-forge section 12*a*, second pre-forge section 13*a* is forged as second journal 13, after which the entire blank is again cooled down before heating the next section of the blank for forging. The process steps of section heating; section forging; and blank cool down are sequentially repeated for each subsequent feature of the large crankshaft, for example, as illustrated in FIG. 1(*d*) through FIG. 1(*g*) for journals 14 though 17.

Cool down of the entire blank after each section forging is driven by the necessity of having the same initial thermal conditions throughout the longitudinal length of the next section to be pre-forge heated so that the induction heating process heats the next section to a substantially uniform temperature throughout the longitudinal length of the next section. Without the cool down step, heat from the previous (last) forged section will axially flow by thermal conduction into the next section to create a non-uniform temperature distribution profile across the axial length of the next section, which will result in a non-uniform temperature distribution profile across the length of the next section after it is inductively heated within induction coil 20. These cool down steps are both time consuming and energy inefficient since heat energy dissipation to ambient in the cool down steps represents a non-recoverable heat and energy loss. Consequently overall energy consumption is dramatically increased with substantial reduction in overall process efficiency.

FIG. 2(*a*) through FIG. 2(*d*) illustrate the effects of an insufficient cool down of the blank after each section pre-forge heat step described in the FIG. 1(*a*) through FIG. 1(*g*) process. Depending upon the mass of the blank; material composition of the blank; and required pre-forge final temperature, it could take from around 30 minutes to more than 60 minutes to inductively heat the first pre-forge section 12*a* of the blank as shown in FIG. 2(*a*). Due to thermal conduction, there will be a substantial quantity of heat flowing from inductively heated high temperature pre-forge section 12*a* towards the end of the blank at a cooler (ambient) temperature. Upon completion of the first heating stage for pre-forge section 12*a* shown in FIG. 2(*a*), the blank is transported to the forging apparatus for forging the crankshaft feature in heated pre-forge section 12*a*. Typically the transport-to-forge apparatus step consumes several minutes. Additionally it also takes several minutes to forge the heated pre-forge section of the blank into the required crankshaft feature, and then several more minutes to transport the blank back to the induction coil for coil insertion and heating of the next pre-forge section 13*a* of the blank as shown in FIG. 2(*b*). Consequently during the forging and transport steps there is an appreciable time period for thermal conduction of heat from the already heated hot sections towards the cooler (unheated) sections of the blank, and when the next pre-forge section is positioned within induction coil 20, for example, pre-forge section 13*a*, as shown in FIG. 2(*b*), there will be a substantial residual heat concentration in pre-forge section 13*a* before induction heating thanks to axial heat conduction (illustrated by the "HEAT" arrows in the figures) from forged section 12 to pre-forge section 13*a*. More importantly the heat concentration in pre-forge section 13*a* will produce an appreciably non-linear initial temperature distribution along the length, $L_{13}$, of pre-forge section 13*a*.

Furthermore during the induction heating step of pre-forge section 13*a*, previously heated and forged first journal 12 (shown in dense crosshatch in FIG. 2(*b*) to indicate above ambient heated temperature) will serve as a source of heat with conduction heat flow towards next pre-forge section 13*a*, which will affect, in a non-linear manner, both transient and final temperature distributions in the blank, including the temperature uniformity of inductively heated pre-forge section 13*a*. Similarly upon completion of the heating and forging steps for second journal section 13, and prior to the heating step for next pre-forge section 14*a* as show in FIG. 2(*c*), there will be further, and more complex, heat flow gradients within the not-yet-forged sections of the blank due to thermal conduction. The initial temperature profile prior to induction heating of pre-forge section 14*a* of the blank is formed by complex thermal flow patterns in the blank resulting from the sequence of heating; transport-to-forge apparatus; forging; and transport-to-coil steps associated with forming first and second journals 12 and 13 as shown in FIG. 2(*c*). Non-uniformity of the initial temperature distribution prior to induction heating of the next pre-forge section 15*a* will further increase due to the cumulative impact of the previously heated and forged first 12, second 13 and third 14 journals of blank 10 as shown in FIG. 2(*d*).

FIG. 3(*a*) through FIG. 3(*f*) further illustrate the effect of the initial temperature on the final thermal conditions of blank 10 without cool down after each induction heating and forging steps for a section of the blank with the process described in FIG. 1(*a*) through FIG. 1(*g*). As shown in FIG. 3(*a*) at the beginning of the heating cycle, pre-forge section 12*a* is positioned inside of multiple turn induction coil 20. AC current is supplied to the induction coil from a suitable source (not shown in the drawings) to generate a magnetic field that couples with pre-forge section 12*a* to inductively heat pre-forge section 12*a*. Points, or nodes $\mathbf{1}_{12}$ through $\mathbf{3}_{12}$ (subscripts indicating sections in which the nodes are located), as illustrated in FIG. 3(*a*), represent typical critical nodes at the surface of pre-forge section 12*a*, which requires uniform heating by induction prior to forging. Node $\mathbf{4}_{13}$ is in section 13 of the blank located in proximity to the required uniformly heated pre-forge section 12*a*. Initial axial temperature distribution ($T_{INITIAL}^{12}$) prior to start of the induction heating step for first pre-forge section 12*a* is uniform, and typically corresponds to ambient temperature. The surface node locations versus temperature graph in FIG. 3(*b*) shows an initial temperature distribution ($T_{INITIAL}^{12}$) in the axial direction, and a required surface temperature distribution ($T_{FINAL}^{REQ}$) at the end of the induction heating step for pre-forge section 12*a*. As described above, after the completion of induction heating of pre-forge section 12*a*, the sequence of transport-to-forge apparatus; forging; and transport-to-coil for the next section heating steps are performed, after which pre-forge section 13*a* will be positioned within induction coil 20 as shown in FIG. 3(*c*). During the time consumed by the above process steps, thermal conduction flow along the longitudinal axis results in a substantially non-uniform initial temperature distribution ($T_{FINAL}^{13}$) prior to the start of the induction heating step for second pre-forge section 13*a* as shown in the surface node locations versus temperature graph in FIG. 3(*d*). Temperature distribution ($T_{INITIAL}^{13}$) will be substantially non-uniform and appreciably different from temperature distribution ($T_{INITIAL}^{12}$). The initial temperature at node $\mathbf{1}_{13}$ ($T_1$) in the FIG. 3(*d*) graph will be appreciably greater than the temperatures at nodes $\mathbf{2}_{13}$ ($T_2$), $\mathbf{3}_{13}$ ($T_3$) and $\mathbf{4}_{14}$ ($T_4$); generally, $T_1>T_2>T_3>T_4>(T_{INITIAL}^{12})$. If the induction heating process for pre-forge section 13*a* is the same as that used for pre-forge section 12*a*, the final temperatures ($T_{FINAL}^{ACTUAL}$) at the representative nodes will be noticeably higher then the required temperatures ($T_{FINAL}^{REQ}$) as graphically shown in the FIG. 3(*d*).

Process parameters playing a dominant role in the final temperature after the induction heating of each pre-forge section include: initial temperature of the pre-forge section; physical properties of the blank (primarily the specific heat value of the blank's composition); induced power in the pre-forge section; total induction heating time of the pre-forge section; and thermal surface losses from the blank due to heat convention and thermal radiation, which can be calculated from the following equation:

$$T_{FINAL} = T_{INITIAL} + \left(\frac{P_{IND} \times T_{IND}}{m \times c}\right) - Q_{SURF} \qquad \text{[equation (1)]}$$

where $T_{IND}$ is the time (in seconds) of induced heating; $P_{IND}$ is the power (in kW) induced in the pre-forge section; m is the mass (in kg) of the inductively heated pre-forge section; c is the specific heat (in J/(kg·° C.)) of the blank's material composition, and $Q_{SURF}$ is the surface heat losses (in ° C.) including radiation and convection. Equation (1) illustrates that there is a direct correlation between final temperature $T_{FINAL}$ and initial temperature $T_{INITIAL}$, assuming all other factors remain the same.

When pre-forge section 13*a* absorbs a sufficient amount of induced heat energy during the heating step shown in FIG. 3(*c*), blank 10 is removed from induction coil 20 and is transported to the forging apparatus (not shown in the drawings) to forge second journal 13, after which the blank is transported back to the induction coil for heating of next pre-forge section 14*a* as shown in FIG. 3(*e*). However initial temperatures at nodes $\mathbf{1}_{14}$ through $\mathbf{3}_{14}$, and $\mathbf{4}_{15}$ will now be appreciably higher as illustrated in the surface node locations versus temperature graph in FIG. 3(*f*). With the process described in FIG. 1(*a*) through FIG. 1(*g*) this overheating will be further aggravated, and initial thermal conditions, ($T_{INITIAL}^{14}$), prior to induction heating of the next pre-forge section will cause further increase in the final temperature ($T_{FINAL}^{ACTUAL}$) compared to the required final temperature ($T_{FINAL}^{REQ}$) as graphically shown in FIG. 3(*f*). Overheating can result in irregularities such as grain boundary liquation, metal loss due to excessive oxidation and scale, decarburization, improper metal flow during forging, forging defects (for example, crack development), or excessive wear of forge dies. Any of these irregularities can result in degraded performance of the forged article of manufacture.

Therefore with the conventional process described above, an uncertainty in the initial thermal profile along the longitudinal axis of the blank prior to heating the second, third, and successive pre-forge sections of the blank can lead to undesired thermal conditions in the pre-forge sections, including lack of temperature uniformity along the longitudinal axis in a pre-forge section. In the conventional process described above, this is avoided by the inefficient step of cool down after forging of each pre-forge section before induction heating of the next pre-forge step.

One object of the present invention is to produce a non-unitarily forged article of manufacture, such as a large crankshaft from a blank, or other large shaft article with a plurality of irregularly shaped cylindrical components, by sequential induction heating of each pre-forge section without the necessity of cooling down the crankshaft after forging each heated pre-forge section, by utilizing the heat absorbed in the blank during previous cumulative heating steps and reducing the required energy consumption.

BRIEF SUMMARY OF THE INVENTION

In one aspect the present invention is a method of, and apparatus for, manufacturing a large, non-unitarily forged shaft workpiece having a plurality of irregularly shaped cylindrical components that are individually forged after induction heating separate sections of the shaft. Successive induction heating and forging of shaft components is accomplished without cool down between forging and heating steps by sensing the actual temperature distribution along the axial length of the next section of the shaft to be inductively heated and forged. The temperature profile of the next section is used to adjust the amount of induced heating power along the length of the next section so that a required (for example substantially uniform) temperature profile along the axial length is achieved prior to forging the next section. The sensed temperature profile data from a forged shaft workpiece may be used to adaptively adjust the amount of induced heating power along the length of the next shaft workpiece to be forged.

In another aspect, the present invention comprises a large, non-unitarily forged shaft workpiece having a plurality of irregularly shaped cylindrical components that is manufactured by a process disclosed in this specification.

The above and other aspects of the invention are set forth in this specification and the appended claims.

BRIEF DESCRIPTION OF THE DRAWINGS

The appended drawings, as briefly summarized below, are provided for exemplary understanding of the invention, and do not limit the invention as further set forth in this specification and the appended claims:

FIG. 4(*a*) through FIG. 4(*c*) illustrate one method of sensing the surface temperatures along the longitudinal axis of a pre-forge section of a shaft workpiece as used in the present invention.

DETAILED DESCRIPTION OF THE INVENTION

Figure 1A:
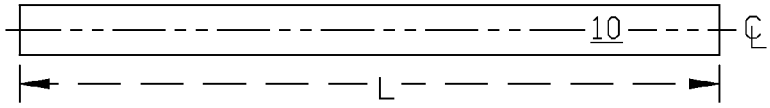
FIG. 1(*a*) through FIG. 1(*g*) diagrammatically illustrate a sequence of induction heating and forging steps used in a process to manufacture non-unitarily forged crankshafts.
Figure 1B:
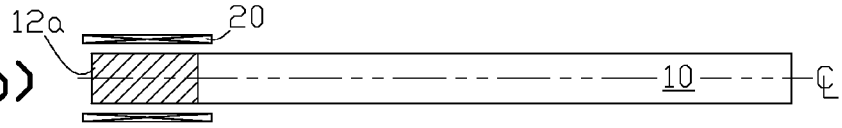
Figure 1C:
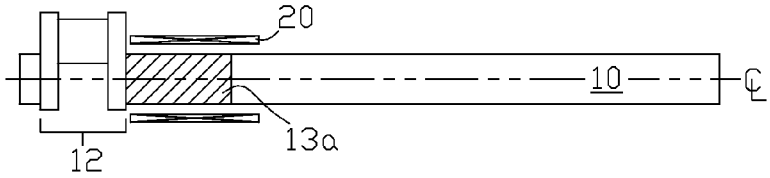
Figure 1D:
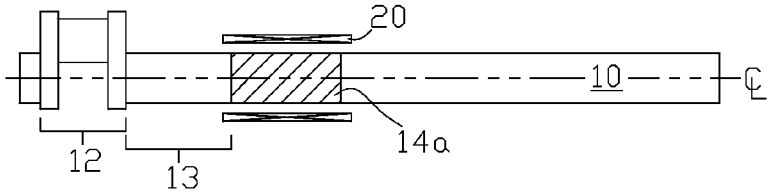
Figure 1E:
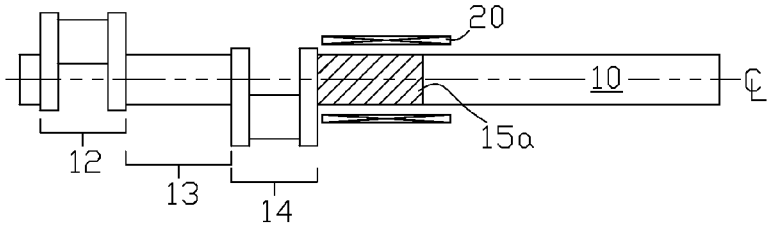
Figure 1F:
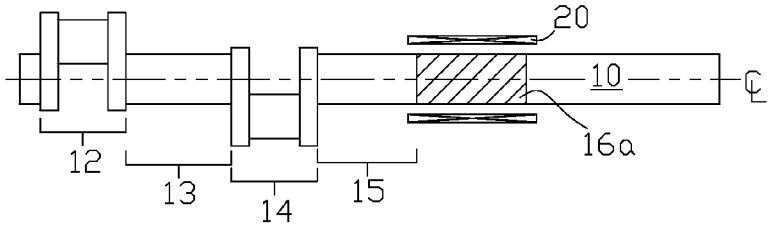
Figure 1G:
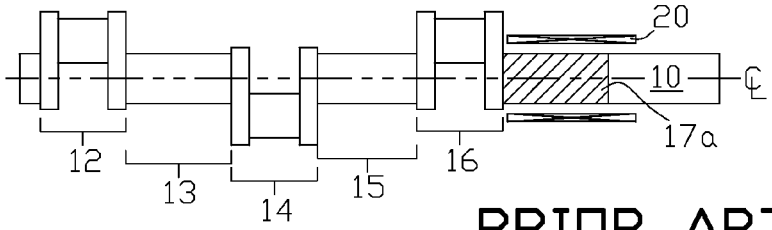
Figures 2A, 2B, 2C, 2D:
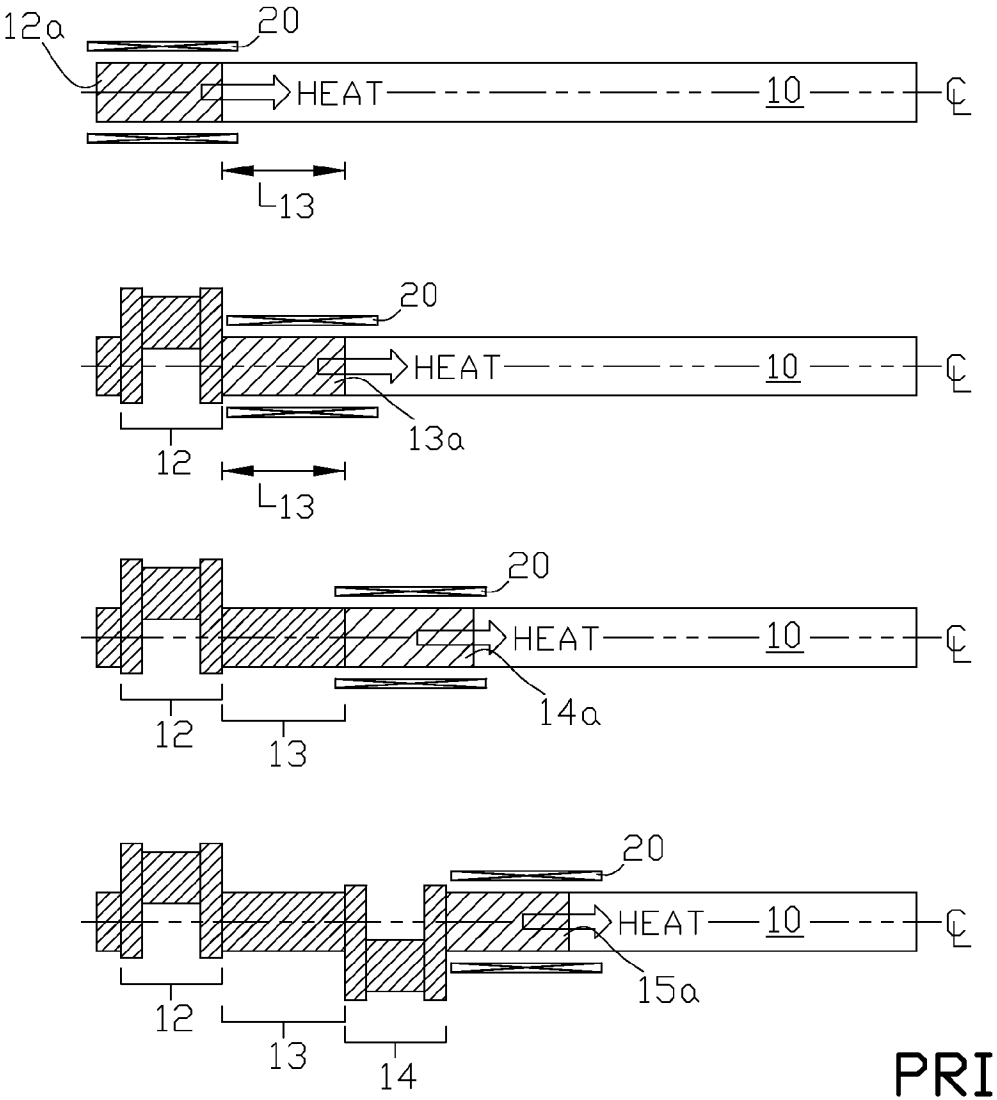
FIG. 2(d) PRIOR ART
FIG. 2(*a*) through FIG. 2(*d*) diagrammatically illustrate regions of elevated temperatures along the axial length of a blank as successive pre-forge sections are inductively heated along the length of the blank and forged if the blank is not cooled down to ambient temperature after forging each section of the blank.
Figure 3A:
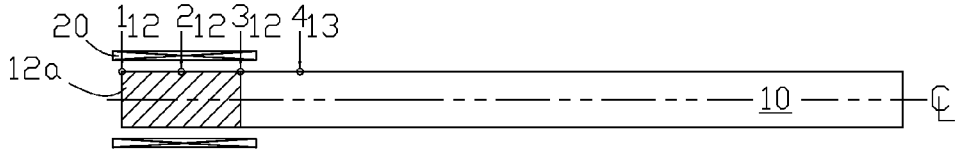
FIG. 3(*a*) through FIG. 3(*f*) diagrammatically and graphically illustrate typical non-uniform initial temperature profiles prior to induction heating of the second and third pre-forge sections of a blank, and their effect on the final temperature distribution, and overheating, of each subsequent pre-forge section if the non-unitarily forged article of manufacture is not cooled down to ambient temperature after completion of forging the section of the article from each subsequent pre-forge section.
Figure 3B:
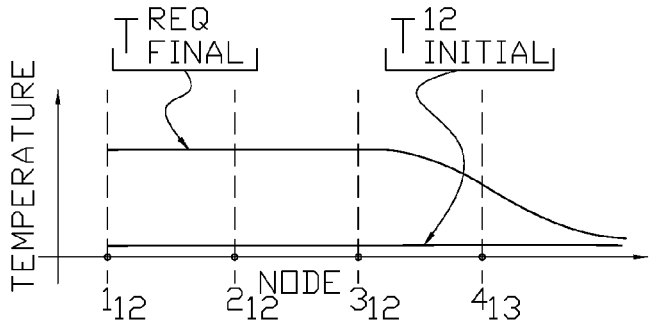
Figure 3C:
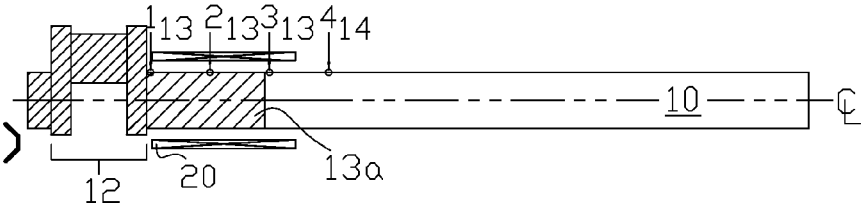
Figure 3D:
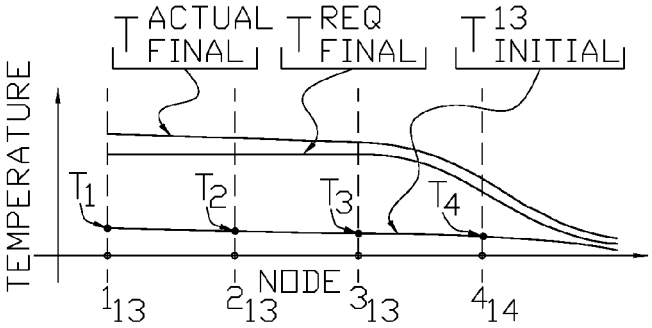
Figure 3E:
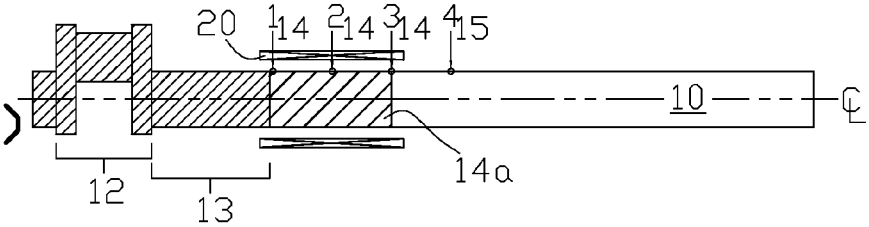
Figure 3F:
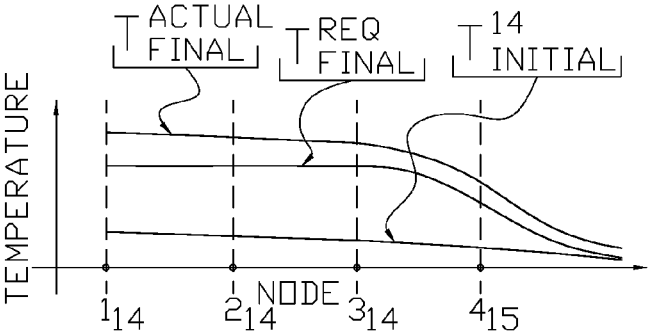

FIG. 4(*a*) through FIG. 4(*c*) illustrate one example of pre-forge temperature sensing along the axial length of a section that can be used in the present invention. In this example, the workpiece or blank 10 is cylindrical in shape and the axial length is measured parallel to the central (centerline) longitudinal axis of the cylinder. First pre-forge section 12*a* can be inductively heated (as shown in FIG. 4(*a*)) and forged as described above in the conventional process, if the initial axial temperature distribution profile of the first pre-forge section is as required, for example, at a uniform ambient temperature.

Prior to loading the second (and subsequent) pre-forge section 13*a* into induction heating coil assembly 22, a longitudinal axis (axial length) temperature distribution profile can be generated by measuring the temperature of the pre-forge section of the blank with suitable temperature sensing device (TS) 30, for example, as the blank is loaded into coil assembly 22. Temperature sensing device 30 may be, for example, a single pyrometer (or multiple pyrometers) distributed along the X-axis preceding the blank-entry end 22*a* of the coil assembly. The one or more temperature sensors can sense the surface temperature of the blank as it is inserted into the blank-entry end of the coil assembly (from left to right orientation as shown in FIG. 4(*b*)). Temperature readings may be continuous, or discrete, as the axial length of the blank passes the one or more temperature sensors.

One or more of the temperature sensors may alternatively be of a type that measures temperatures into the thickness of the blank, or utilizes any range of the electromagnetic spectrum for temperature sensing. Multiple sensors may be assembled on a common support rack. The blank and/or sensors may be rotated, or the sensors may surround the perimeter of the blank if circumferential non-uniform temperatures are of concern. Alternatively one or more temperature sensors may be interspaced within coil assembly 22 so that the temperature sensing can be accomplished as the section of the blank is inserted into the coil, or after the section has been inserted into the coil.

In one example of the invention, as the remaining non-forged portion of blank 10 moves into the heating position inside of induction coil assembly 22, the initial pre-heat surface temperature profile along the longitudinal axis of the next section of the blank to be pre-forge heated can be sensed and monitored using a single pyrometer. The pyrometer is positioned in front of the entry end 22*a* of the coil assembly, and while the non-forged blank is inserted into the coil assembly via suitable conveyance apparatus, the pyrometer scans, or senses, the blank's surface temperature along the length of the next section to be inductively heated and transmits the scanned temperature data to control system (C) 32, which in turn, controls components of the induction heating system via suitable interfaces, such as configuration of the coil assembly and the output parameters of the one or more power supplies connected to the coil assembly, to achieve a require temperature distribution along the axial length of pre-forge section 13*a* of the blank.

As shown in FIG. 4(*c*) data from temperature sensing device 30 is transmitted to control system 32, and is used by the control system to modify the magnetic (flux) field distribution established by AC current flow through components of coil assembly 22 to redistribute induced power density within pre-forge section 13*a* that is being inductively heated in FIG.

4(*c*) responsive to the required temperature distribution. The redistribution of induced power density compensates for the non-uniform initial (actual) temperature profile ($T_{INITIAL}^{13}$) as graphically illustrated in FIG. 4(*c*), and provides the required (for example, uniform) final heating conditions ($T_{FINAL}^{REQ}$) in pre-forge section 13*a*. If the induced power density distribution was not modified, the non-uniform initial temperature, ($T_{INITIAL}^{13}$), would result in an appreciably different final temperature profile ($T_{FINAL}^{CONVENTIONAL}$) compared to the required temperature distribution ($T_{FINAL}^{REQ}$). The lack of a controlled heating profile can lead to undesirable properties in the forging of any section of the blank.

Figure 5A:
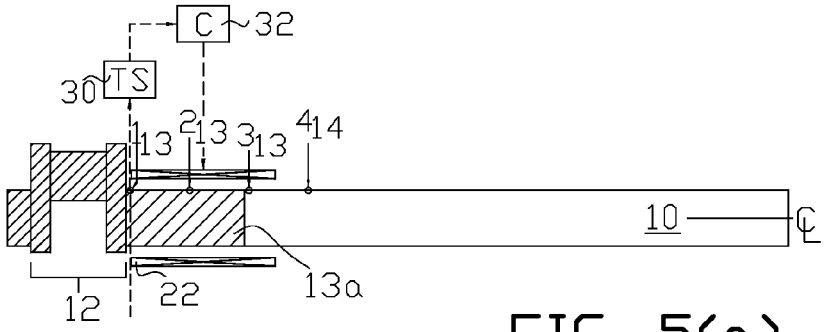
FIG. 5(*a*) through FIG. 5(*i*) illustrate various arrangements of induction heating apparatus used in the present invention to dynamically control induced power applied along the longitudinal axis of a pre-forge section of the workpiece.
Figure 5B:
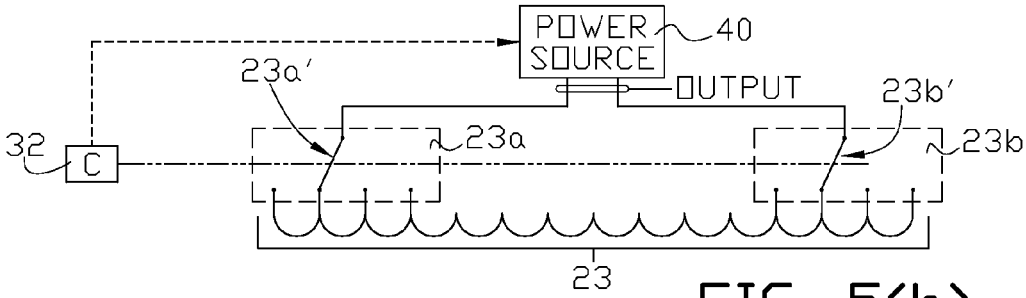
Figure 5C:
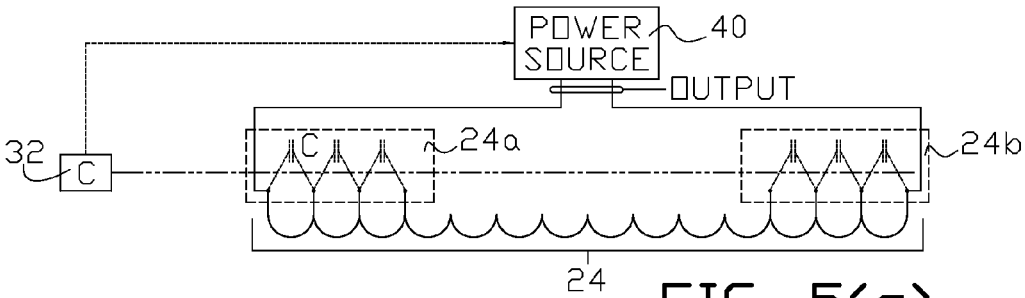
Figure 5D:
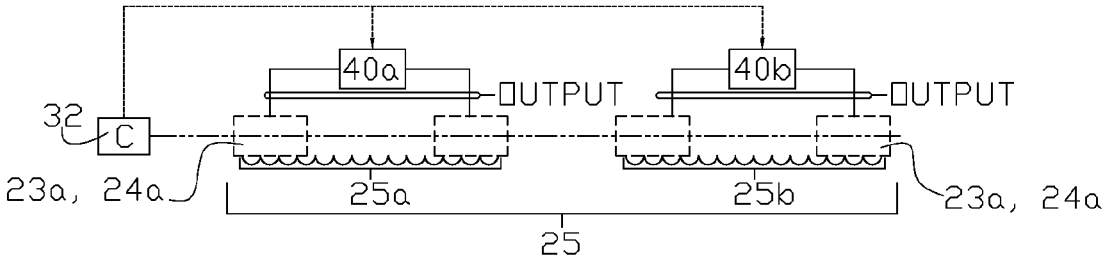
Figure 5E:
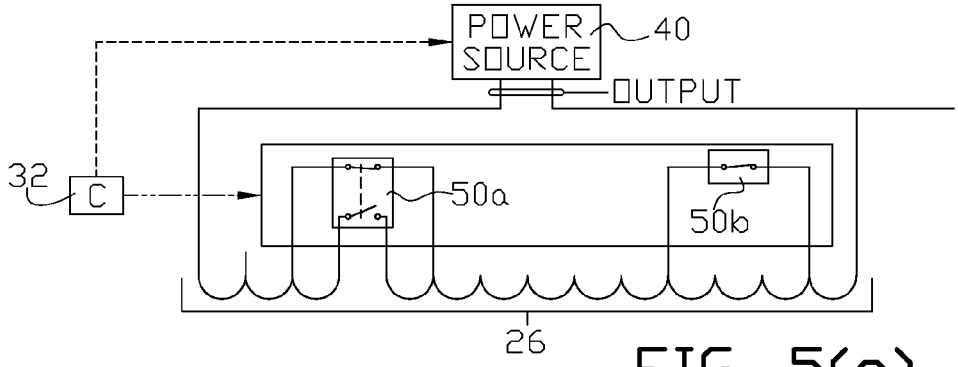
Figure 5F:
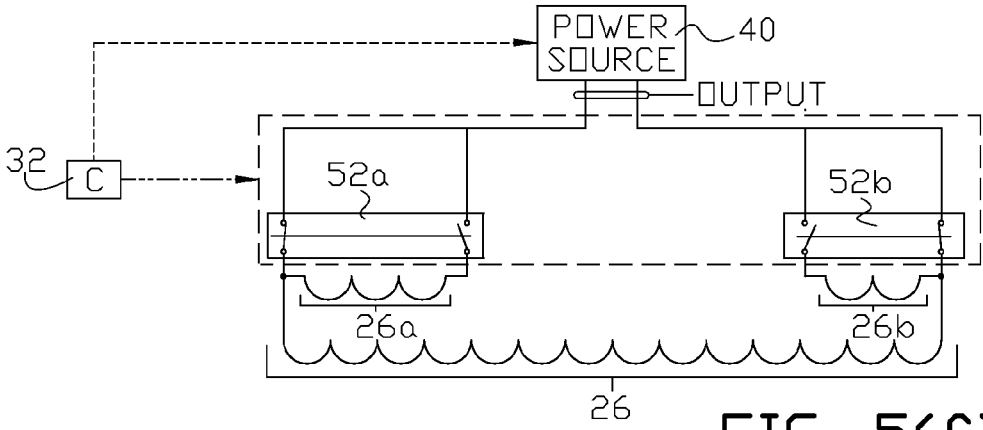
Figure 5G:
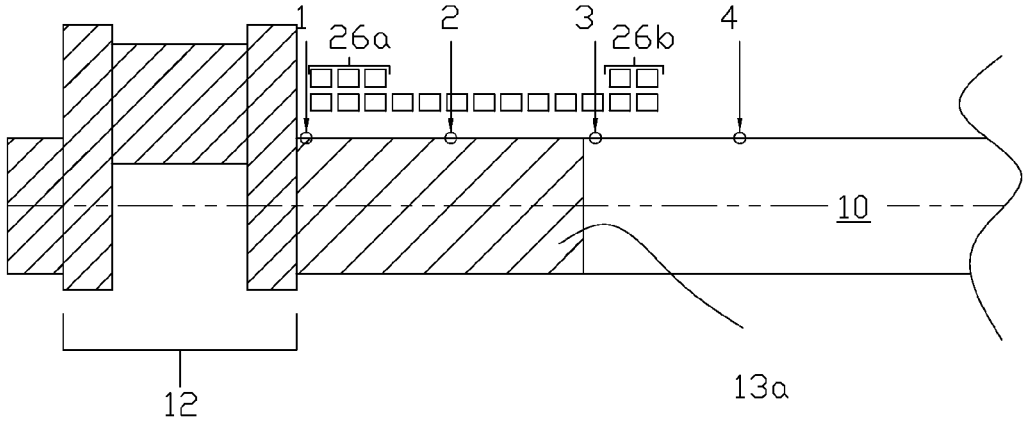
Figure 5H:
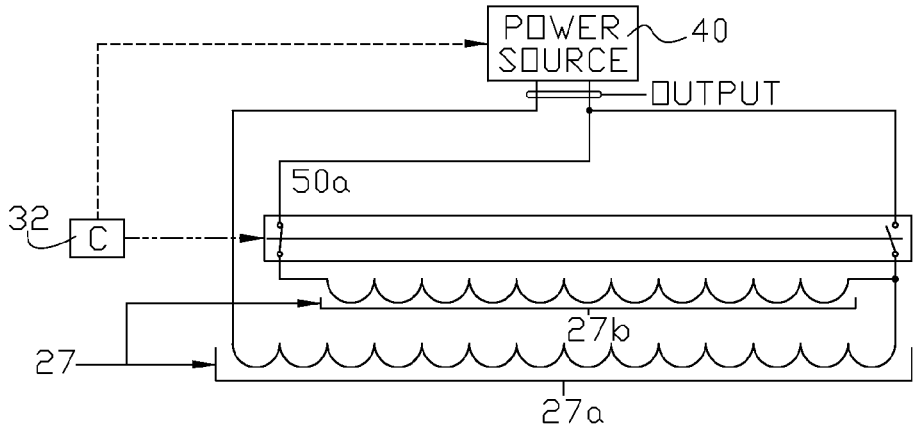
Figure 5I:
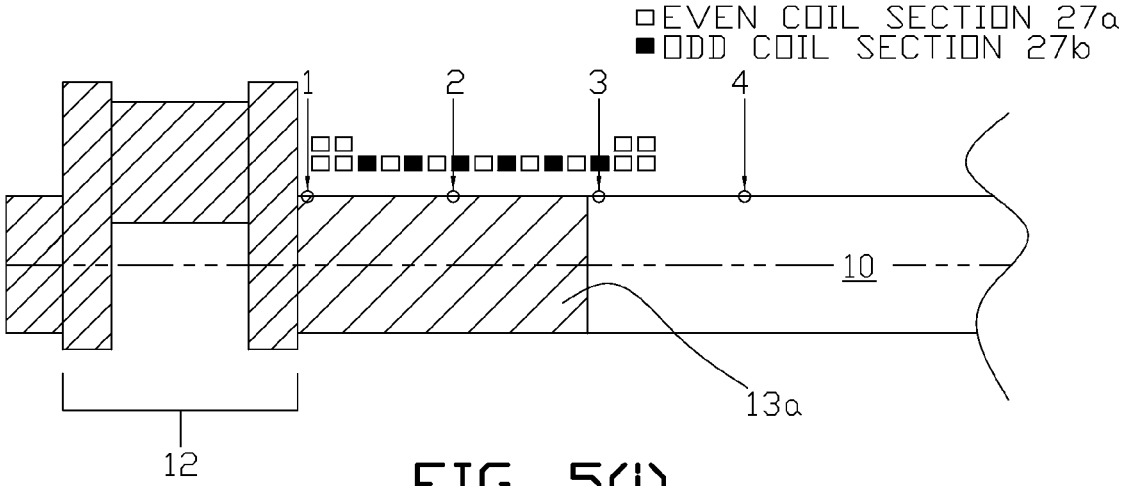
Figure 6:
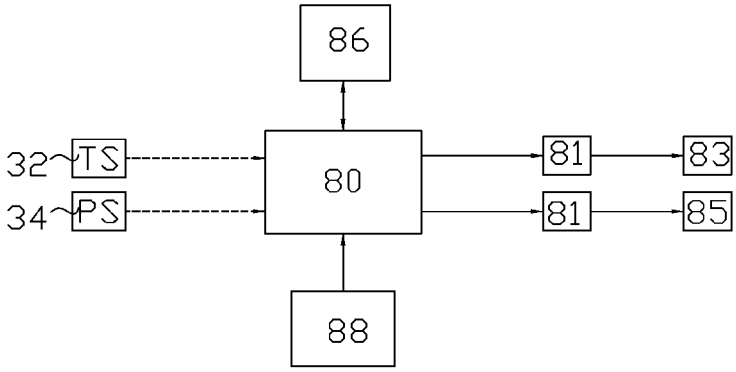
FIG. 6 illustrates in block diagram form one example of a control system used with an application of electric induction energy for manufacture of non-unitarily forged workpieces utilized in the present invention.

Depending upon the particular application of the present invention, alternative arrangements of induction coil assembly 22 can be used to redistribute and selectively control induced power density along the axial length of pre-forge section 13*a* (and each successive blank pre-forge section) that is to be inductively heated as shown in FIG. 5(*a*).

FIG. 5(*b*) illustrates one example of a coil assembly used in the present invention to redistribute and selectively control induced power density along the axial length of a pre-forge section to be heated. Multiple turn solenoidal induction coil 23 includes multiple selective end tap assemblies 23*a* and 23*b* at opposing ends of the coil that can be used to compensate for a non-uniform (or otherwise undesirable) initial surface temperature profile of pre-forge section 13*a* when inductively heating pre-forge section 13*a*. Control system 32 can control the positions of end tap connectors 23*a*' and 23*b*' to connect the appropriate coil end tap to the output of power supply 40. Based on temperature data transmitted from temperature measuring device 30, control system 32 switches between appropriate coil end tap terminals 23*a* and/or 23*b* at the coil end(s) prior to, or during, induction heating of pre-forge section 13*a* to modify the induced heat distribution in pre-forge section 13*a* to produce the required pre-forge temperature distribution along the axial length of pre-forge section 13*a*.

FIG. 5(*c*) illustrates another example of a coil assembly used in the present invention to redistribute and selectively control induced power density along the axial length of a pre-forge section to be heated. By selectively connecting (for example, by contactors not shown in the drawing) one or more capacitive elements, C, in capacitor banks 24*a* or 24*b* across one or more coil sections of induction coil 24 (representatively shown in dashed lines), localized induced heating of the pre-forge section inserted in the coil can be achieved by increasing the magnitude of induced currents in the required regions from selective formation of localized coil-resonant L-C circuits that allow for compensation of a non-uniform initial surface temperature profile sensed by temperature sensing device 30.

FIG. 5(*d*) illustrates another example of a coil assembly used in the present invention to redistribute and selectively control induced power density along the axial length of a pre-forge section to be heated. In this example at least two coil sections 25*a* and 25*b* of induction coil 25 are supplied power from two independently controlled power sources 40*a* and 40*b* (for example, two independently controlled power inverters outputting AC power). Separate control of power from each power source can be used to compensate for a non-uniform (or otherwise undesirable) initial surface temperature profile of pre-forge section 13*a* while also incorporating either the variable end coil taps, or capacitive elements shown in FIG. 5(*b*) or FIG. 5(*c*), respectively. Output power control from each power supply may be output frequency and/or output power magnitude accomplished, for example, by a pulse width modulated control scheme.

FIG. 5(*e*) illustrates another example of a coil assembly used in the present invention to redistribute and selectively control induced power density along the axial length of a pre-forge section to be heated. One or more switching devices, for example, illustrative switching devices 50*a* and/or 50*b* can be used to electrically short out one or more coil turns of multiple turn solenoidal induction coil 26 to redistribute induced power density along the axial length of pre-forge section 13*a* to compensate for the initial undesired surface temperature profile measured by temperature sensing device 30.

FIG. 5(*f*) and FIG. 5(*g*) illustrate another example of a coil assembly used in the present invention to redistribute and selectively control induced power density along the axial length of a pre-forge section to be heated. Induction coil 26 comprises a multiple layer, multiple turn induction coil that is utilized to redistribute induced power density along the axial length of pre-forge section 13*a* to compensate for an initial undesired pre-heat surface temperature distribution profile and establish the required final pre-forge thermal conditions in pre-forge section 13*a*. FIG. 5(*g*) illustrates the partial multi-layer coil arrangement at opposing ends of induction coil 26. For example, switching devices 52*a* and/or 52*b* can be used to selectively alter the circuit configuration of coil ends 26*a* and 26*b*, respectively, of multi-layer induction coil 26 to redistribute induced power density in pre-forge section 13*a* and compensate for the initial undesired pre-heat surface temperature distribution to establish the required final pre-forge thermal conditions in pre-forge section 13*a*.

FIG. 5(*h*) and FIG. 5(*i*) illustrate another example of a coil assembly used in the present invention to redistribute and selectively control induced power density along the axial length of a pre-forge section to be heated. Induction coil 27 comprises at least two coil sections 27*a* and 27*b* connected in parallel as shown in the figures. Referring to FIG. 5(*i*) induction coil 27 has a double helix design representing two alternating helixes 27*a* and 27*b* connected in parallel. In this particular example of the invention, alternating turns of coil 27 comprise interlaced "even" coil section 27*a* (designated by the non-shaded squares in FIG. 5(*i*)) and "odd" coil section 27*b* (designated by the shaded squares in FIG. 5(*i*). By energizing and de-energizing one of the odd or even sections (for example, odd section 27*b*), control device 32 redistributes induced heat sources (induced power density) along the axial length of the pre-forge section that compensates for an initially undesired (typically non-uniform) axial length surface temperature distribution and achieves the required final thermal conditions for the pre-forge section inserted in the induction coil. The example shown in FIG. 5(*i*) also optionally includes the end multi-layer coil arrangement as described above relative to FIG. 5(*f*) and FIG. 5(*g*).

In a particular application, various combinations of the coil assemblies described above may be used in the present invention to redistribute and selectively control induced power density along the axial length of a pre-forge section to be heated.

FIG. 7 further illustrates one example of a control system for use with the present invention. Processor 80 can be any suitable computer processing unit such as a programmable logic controller. One or more temperature sensing devices 32 input temperature data along the axial length of the blank at least for the next pre-forge section to be inductively heated in the induction coil assembly for forging. Optionally the temperature along the entire axial length of the remaining blank may be inputted each time the blank is inserted in the induction coil assembly so that a dynamic change in heating profile along the entire length of the remaining blank is recorded. An additional input to the processor may be one or more position sensors 34 (such as a laser beam sensor), which coordinates the inputted temperature data with a specific location along the axial length of the blank. Processor 80 executes one or more heating computer programs that analyze the inputted temperature data to generate an actual blank temperature distribution profile. The program compares the actual blank temperature distribution profile with a required pre-forge blank temperature distribution profile that may be stored on digital storage device 86 or inputted via a suitable input device 88 by a human operator. The software generates an induction heating system control program for execution dependent upon the difference between the actual blank and required pre-forge blank temperature distribution profiles, and the particular installed induction heating system. Responsive to the induction heating system control regime, processor 80 outputs control signals via suitable input/output (I/O) devices 81 to electrical switching devices 83 associated with the particular installed coil assembly, for example, as alternatively described in FIG. 5(*a*) through FIG. 5(*i*), and to control circuitry associated with the one or more power sources associated with a particular installed induction heating system. For example IGBT gating control in the output inverter(s) of the one or more power sources may be used to control the magnitude and duration of output power of each of the one or more power sources. Application of induced power to the blank may begin while the blank is still being inserted into the coil assembly, or after the blank has been completely inserted into the coil assembly. For sequential heating of the sections of different blanks with the same physical and metallurgical compositions, the control system may recall from stored memory the heating system control regime used for the heating of the prior blank to expedite determination of the heating system control regime for the next similar blank.

The relative term "large" as used is used herein refers to shaft workpieces that can not be entirely forged in one forging process. Generally these shaft workpieces include crankshafts with journals having a diameter greater than 75 mm (3 inches) and lengths in excess of 1 meter.

While the article of manufacture described in the above examples of the invention is a non-unitarily forged crankshaft, the invention is more generally applicable to other non-unitarily forged articles of manufacture where a particular pre-forge axial temperature profile is desired for a section of the article.

While a uniform surface temperature profile is designated as the required end temperature profile along the axial length of the pre-forge section inserted in the induction coil assembly, in other examples of the invention other non-uniform end temperature profiles can be achieved by the processes of the present invention.

The present invention has been described in terms of preferred examples and embodiments. Equivalents, alternatives and modifications, aside from those expressly stated, are possible and within the scope of the invention.

The invention claimed is:

1. A method of forging a non-unitarily forged article of manufacture from a blank, the method comprising the steps of: (1) inserting a section of the blank in an induction coil assembly; (2) electric induction heating the section of the blank in the induction coil assembly by supplying electric power to the induction coil assembly to generate a magnetic flux field that couples with the section of the blank in the induction coil assembly to form a pre-forge heated section of the blank; (3) withdrawing the blank from the induction coil assembly; (4) transporting the blank to a forge apparatus; (5) forging a feature in the pre-forge heated section of the blank; (6) transporting the blank to the induction coil assembly; and sequentially repeating steps (1) through (6) until the entire article of manufacture is forged, the improvement comprising the steps:

sensing the temperature along the axial length of the section of the blank in the induction coil assembly; and controlling the coupling of the magnetic flux field along the axial length of the section of the blank in the induction coil assembly to heat the section of the blank in the induction coil assembly to a pre-forge axial length temperature profile.

2. The method of claim 1 wherein the step of sensing the temperature along the axial length of the section of the blank in the induction coil assembly is performed simultaneously with the step of inserting the section of the blank in the induction coil assembly.

3. The method of claim 1 wherein the step of sensing the temperature along the axial length of the section of the blank in the induction coil assembly is performed subsequent to the step of inserting the section of the blank in the induction coil assembly.

4. The method of claim 1 wherein the step of controlling the coupling of the magnetic flux field comprises forming two or more alternative electrical end taps at least at one end of the induction coil assembly; and changing an end terminal connection of the induction coil assembly between the two or more alternative electrical end taps prior to, or during, the step of electric induction heating the section of the blank in the induction coil assembly.

5. The method of claim 1 wherein the step of controlling the coupling of the magnetic flux field comprises electrically connecting one or more capacitors across one or more end windings of the induction coil assembly prior to, or during, the step of electric induction heating the section of the blank in the induction coil assembly.

6. The method of claim 1 wherein the step of controlling the coupling of the magnetic flux field comprises forming the induction coil assembly from at least two separate induction coil sections, each of the at least two separate induction coil sections having the supplied electric power from a separate power source; and forming two or more alternative electrical end taps at least at one end of the induction coil; and changing an end terminal connection of the induction coil assembly between the two or more alternative electrical end taps prior to, or during, the step of electric induction heating the section of the blank in the induction coil assembly, or electrically connecting one or more capacitors across one or more end windings of the induction coil assembly prior to, or during, the step of electric induction heating the section of the blank in the induction coil assembly.

7. The method of claim 1 wherein the step of controlling the coupling of the magnetic flux field comprises shorting one or more coils turns in the induction coil assembly prior to, or during, the step of electric induction heating the section of the blank in the induction coil assembly.

8. The method of claim 1 wherein the step of controlling the coupling of the magnetic flux field comprises forming the induction coil assembly from at least a partially multi-layer coil and switching one or more sections of the partially multi-layer coil prior to, or during, the step of electric induction heating the section of the blank in the induction coil assembly.

9. The method of claim 1 wherein the step of controlling the coupling of the magnetic flux field comprises forming the induction coil assembly from at least two inter-wound helical coils and switching the at least two inter-wound helical coils prior to, or during, the step of electric induction heating the section of the blank in the induction coil assembly.

10. A method of controlling the pre-forge temperature of a section of a blank inserted in an induction coil assembly prior to forging a feature in the section of the blank, the method comprising the steps of:

sensing the surface temperature along the axial length of the section of the blank; and controlling the coupling of the magnetic flux field along the axial length of the section of the blank during induction heating of the section of the blank.

11. The method of claim 10 wherein the step of sensing the surface temperature along the axial length of the section of the blank is performed while the section of the blank is inserted in the induction coil assembly.

12. The method of claim 10 wherein the step of sensing the surface temperature along the axial length of the section of the blank is performed subsequent to insertion of the section of the blank in the induction coil assembly.

13. The method of claim 10 wherein the step of controlling the coupling of the magnetic flux field comprises forming two or more alternative electrical end taps at least at one end of the induction coil assembly; and changing an end terminal connection of the induction coil assembly between the two or more alternative electrical end taps.

14. The method of claim 10 wherein the step of controlling the coupling of the magnetic flux field comprises electrically connecting one or more capacitors across one or more end windings of the induction coil assembly.

15. The method of claim 10 wherein the step of controlling the coupling of the magnetic flux field comprises forming the induction coil assembly from at least two separate induction coil sections, each of the at least two separate induction coil sections having the supplied electric power from a separate power source; and forming two or more alternative electrical end taps at least at one end of the induction coil; and changing an end terminal connection of the induction coil assembly between the two or more alternative electrical end taps, or electrically connecting one or more capacitors across one or more end windings of the induction coil.

16. The method of claim 10 wherein the step of controlling the coupling of the magnetic flux field comprises shorting one or more coils turns in the induction coil assembly.

17. The method of claim 10 wherein the step of controlling the coupling of the magnetic flux field comprises forming the induction coil assembly from at least a partially multi-layer coil and switching one or more sections of the partially multi-layer coil.

18. The method of claim 10 wherein the step of controlling the coupling of the magnetic flux field comprises forming the induction coil assembly from at least two inter-wound helical coils and switching the at least two inter-wound helical coils.

19. A method of forging a non-unitarily forged article of manufacture from a blank, the method comprising the steps of:

(a) inserting a sequential section of the blank in an induction coil assembly;

(b) sensing the temperature along the axial length of the sequential section of the blank inserted in the induction coil assembly;

(c) electric induction heating the sequential section of the blank in the induction coil assembly by supplying electric power to the induction coil assembly to generate a magnetic flux field that couples with the sequential section of the blank in the induction coil assembly to form a pre-forge heated section of the blank with a controlled temperature profile along the axial length of sequential section of the blank inserted in the induction coil assembly responsive to the measured temperature of the sequential section of the blank inserted in the induction coil assembly;

(d) withdrawing the blank from the induction coil assembly;

(e) transporting the blank to a forge apparatus;

(f) forging a feature in the pre-forge heated section of the blank;

(g) transporting the blank to the induction coil assembly; and repeating steps (a) through (g) until the entire article of manufacture is forged.

20. A non-unitarily forged article of manufacture comprising a sequentially forged series of features in a series of sections in a blank, wherein prior to forging each one of the sequentially forged series of features in each one of the series of sections in the blank, each one of the series of sections in the blank is inserted in an induction coil assembly and the coupling of the magnetic flux field along the axial length of each one of the series of sections in the blank is controlled during induction heating of the section of the blank responsive to the temperature sensed along the axial length of each one of the series of sections in the blank prior to induction heating.

* * * * *